US006358423B1

(12) United States Patent
Barten et al.

(10) Patent No.: US 6,358,423 B1
(45) Date of Patent: Mar. 19, 2002

(54) METHOD OF TREATING AND CONDITIONING CIRCULATED ROLLING OIL

(75) Inventors: Axel Barten, Siegen; Arnt Kohlrausch, Hilchenbach, both of (DE)

(73) Assignee: Achenbach Bushchhütten GmbH, Kreuztal (DE)

( * ) Notice: Subject to any disclaimer, the term of this patent is extended or adjusted under 35 U.S.C. 154(b) by 0 days.

(21) Appl. No.: 09/500,872

(22) Filed: Feb. 9, 2000

(30) Foreign Application Priority Data

Feb. 12, 1999 (DE) ..... 199 05 817

(51) Int. Cl.[7] ..... B01D 37/03

(52) U.S. Cl. ..... 210/709; 72/42; 210/712; 210/729; 210/778; 508/268; 508/506

(58) Field of Search ..... 210/708, 709, 210/712, 725, 727, 728, 729, 746, 778; 508/268, 506; 72/42

(56) References Cited

U.S. PATENT DOCUMENTS 5,032,303 A * 7/1991 Bondpä ..... 252/56 R
5,200,086 A * 4/1993 Shah et al. ..... 210/708
5,973,503 A * 10/1999 Kuipers ..... 324/698

* cited by examiner

*Primary Examiner*—Peter A. Hruskoci
(74) *Attorney, Agent, or Firm*—Collard &Roe, P.C.

(57) ABSTRACT

The invention relates to a method for treating and conditioning circulated rolling oil, comprising removing dirt and abrasion particles from the returned rolling oil by filtration, feeding filter aids in a controlled manner, and adjusting an electric conductivity preventing electrostatic charging in the purified rolling oil. So that conductivity additives can be omitted, a flocculating agent is employed as the filter aid, and the amounts in which the agent is added depends on the residual contamination remaining in the filtrate, so that a preset minimum conductivity caused by the remaining residual contamination is preserved in the filtrate.

3 Claims, 1 Drawing Sheet

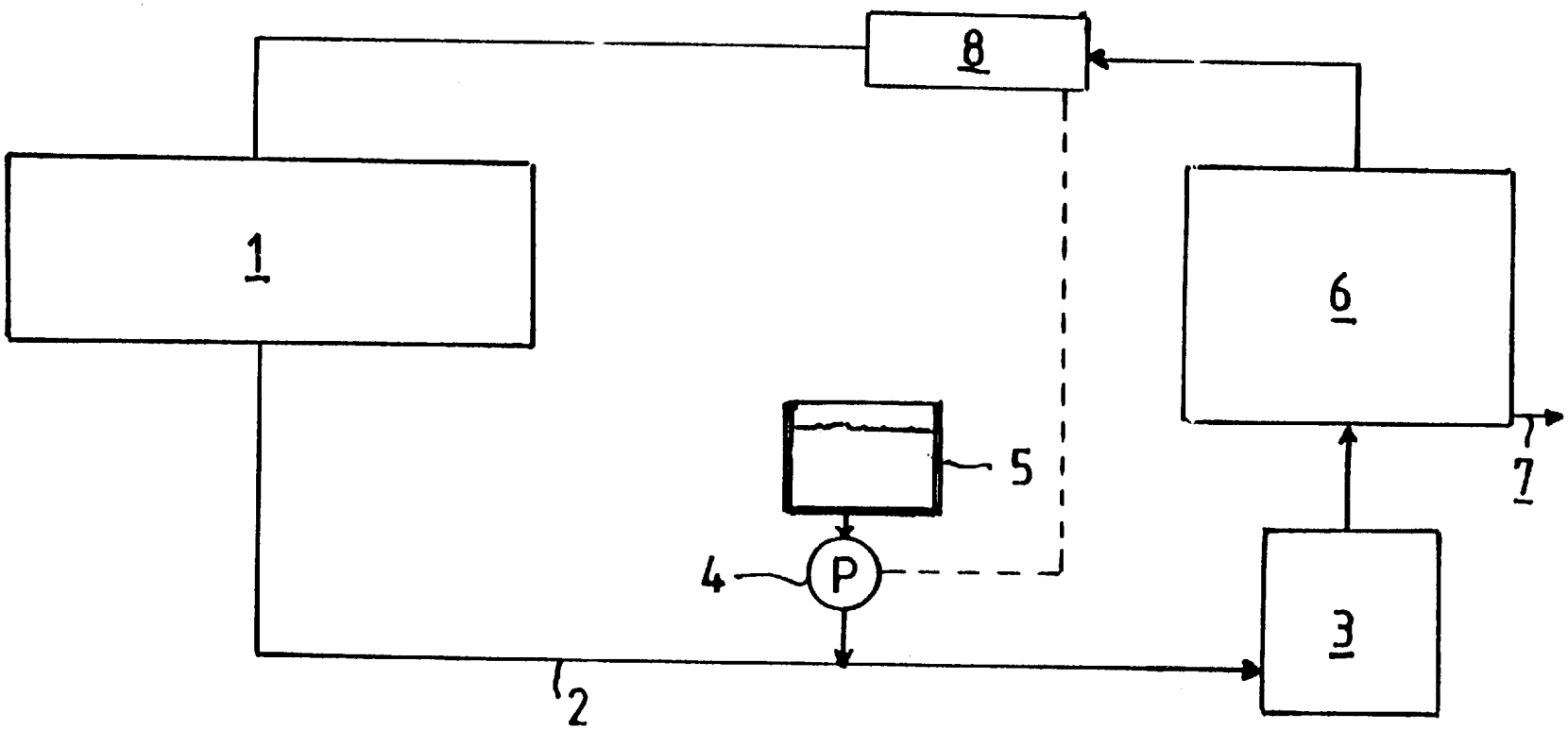
1
2
3
4
P
5
6
7
8

METHOD OF TREATING AND CONDITIONING CIRCULATED ROLLING OIL

BACKGROUND OF THE INVENTION

1. Field of the Invention

This invention relates to a method for treating and conditioning circulated rolling oil, such as rolling oil for aluminum foil rolling mills. The method includes removing dirt and abrasion particles from the returned rolling oil by filtering the oil with controlled addition of auxiliary filtering media (filter aids), and adjusting conductivity to prevent electrostatic charging in the purified rolling oil.

2. The Prior Art

In the rolling of metal foils, rolling oil consisting of a mineral oil fraction with adequate thermal stability is normally used for cooling and lubricating. To reduce the consumption of rolling oil, the oil is usually circulated and continuously purified to an adequate degree and conditioned for reuse. The circulated rolling oil has contaminants that consist substantially of metallic particles from abrasion of the rolled stock, and their oxidation products. The rolling oil is usually cleaned in settling filters such as filter presses, where the abrasion and dirt particles are removed from the rolling oil to the greatest. possible extent.

To enhance the filtration process and in order to obtain a rolling oil that is as pure as possible, diatomaceous or bleaching earth is commonly added to the rolling oil as a filter aid prior to the filtration process. The separation efficiency of the settling filters is distinctly improved by such filtration aids. When conventional filter aids such as diatomaceous and bleaching earth are employed, additional amounts of filtration media are metered into each filtration cycle in addition to basic settling. Dirt particles are embedded in the porous volume of the auxiliary filtration media and their intermediate spaces, and gradually clog the free pores and ducts in the course of a filtration cycle. Since the filter cake is usually not loosened up or reflushed in the course of a current cycle, the relative porosity of the filter cake constantly decreases. Because the volume of the stream is maintained constant, this causes the difference in pressure above the filter cake to rise and the clarification sharpness to increase. The filtrate consequently becomes. cleaner and cleaner.

It is also known to employ a filter aid containing 50% cellulose fibers and 50% citric acid. This filter aid is quite effective. However, its mode of action can be controlled only with difficulty. The filter aid is settled on the filter fleece in the form of a filter cake. Since the interaction of the acid and the contaminants cause chemical effects when this medium is employed, the dwelling time of the participating components plays an important role. This dwelling time is relatively short, so that the mechanism acting in this purification process is relatively slow. Therefore, to obtain a high rate of reaction it is consequently necessary to add a large amount of acid to the filter cake.

For an enhanced separation of the finest of particles, a flocculating agent can be added as a filtering aid to the rolling oil prior to the filtration. The flocculating agent causes the finest particles to be agglomerated to larger agglomerates, so that the particles can be retained in the settling filter in a superior manner.

A substantial problem in the treatment and use of such rolling oils arises from the fact that in its initial state, and also in the purified state, the rolling oil has practically no electric conductivity, i.e. it is a good insulator. This poses the risk of electrostatic charging and the hazard of fire, explosion or deflagration in the rolling mill caused by discharge sparks, which could affect the treatment plants as well.

In order to prevent electrostatic charging, it is also known to admix adequate amounts of conductivity additives. with the rolling oil. These additives raise the conductivity of the rolling oil to such a degree that the electric charge potential addressed above cannot develop. However, such conductivity additives are hazardous to the environment and health, so that any admixing of such agents as a preventive "lump-sum" measure will cause high contamination loads on the environment as well as disposal problems.

SUMMARY OF THE INVENTION

It is therefore an object of the invention to provide a method for treating rolling oil in which the harmful conductivity additives can be omitted without increasing the hazards resulting from electric charging.

This and other objects are accomplished according to the invention by employing a flocculating agent as the filter aid, and controlling the amounts in which the agent is added depending on the residual contamination remaining in the filtrate, so that a preset minimum conductivity caused by the remaining residual contamination is kept preserved in the filtrate.

The invention is based on the idea that an adequate conductivity of the rolling oil can be obtained not only by adding conductivity additives but also by maintaining a sufficiently high residual contamination in the filtrate in a controlled manner, because the abrasion and dirt particles remaining in the rolling oil after the filtration can act just as effectively as a conductivity additive.

The residual contamination is adjusted sufficiently high to prevent electrostatic charging of the rolling oil, on the one hand, and sufficiently low to avoid the formation of stains on the rolled stock, on the other hand.

Diatomaceous or bleaching earth are not used as filter aids in the method according to the invention. Instead, the method according to the invention uses a flocculating agent, so that it is possible to increase the concentration of dirt in the filtrate, if required for control purposes, by reducing the amount of flocculating agent added accordingly. When diatomaceous or bleaching earth are employed as filter aids, the concentration of dirt in the. filtrate can only be reduced further, but not increased again without changing the filters. Likewise, if citric acid were used as filter aid as explained above, overdosing in the filter cake as required for the function could not be reduced again at a sufficiently high rate. Therefore, only the use of a flocculating agent as a filter aid according to the invention permits a controlled adjustment of the residual contamination.

In addition to raising the electric conductivity as explained above, the controlled adjustment of the residual contamination remaining in the rolling oil offers the advantage that superior grip is achieved between the rolls and the stock being rolled. Therefore, not only the electric but also the mechanical properties of the rolling oil are improved.

Finally, with the method according to the invention, the overall consumption of filter aids, i.e., flocculating agent in the present case—is clearly lower than with the methods according to the prior art because complete purity of the filtrate is intentionally waived.

The conductivity in the filtrate is usefully adjusted to values between k1=50 pS/m and k2=5000 pS/m and preferably to between k3=100 ps/m to k4=1000 pS/m, where pS/m=$10^{-12}/\Omega\cdot$m. It has been found that at these values, electrostatic charging of the rolling oil and thus fire, explosion or deflagation caused by such charging are reliably prevented. On the other hand, within this conductivity range, the residual contamination is so low that it will not interfere with the rolling process, and the grip between the surfaces of the rolls and the rolling stock is optimal.

Preferably a dicarbonic acid with the general formula

HOOC—A—COOH is used as the flocculating agent, wherein A is a straight and branched chain of 5 to 15 carbon atoms, or phenylene. The method as defined by the invention works best with such a flocculating agent. Alternatively, of course, other flocculating agents can be employed for the method as defined by the invention as well.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention:

The drawing shows an aluminum foil rolling mill with a connected rolling oil treatment plant.

DETAILED DESCRIPTION OF THE PREFERRED EMBODIMENT

Referring now in detail to the drawing, there is shown schematically the rolling mill denoted by reference numeral 1. Rolling mill 1 is cooled and lubricated with circulating rolling oil. The rolling oil circulation is denoted by the arrows 2.

The rolling oil flowing off from the rolling mill 1 is loaded with abrasion particles and dirt, and fed via a pipeline 2 to a dirty-oil chamber 3. While on its way to chamber 3, a flocculating agent is added to the rolling oil from a supply container 5 via a metering pump 4. The rolling oil enriched with the flocculating agent remains for about 5 minutes in dirty-oil chamber 3 and subsequently passes through a filtration plant 6, which usually is a settling filter. The coarser abrasion and dirt particles as well as the flakes formed by the flocculating agent are separated in filtration plant 6 and removed with the filter cake (see arrow 7). The filtrate draining from filtration plant 6 passes through a measuring chamber 8, where the residual contamination and/or the electric conductivity of the rolling oil proportional to such contamination are measured. Based on the data measured in measuring chamber 8, metering pump 4 is controlled so that the measured electric conductivity in the filtrate is adjusted to values between k1=50 pS/m and k2=5000 pS/m, and preferably between k3=100 pS/m and k4=1000 pS/m, where pS/m=$10^{-12}/\Omega\cdot$m. The rolling oil so adjusted is subsequently. supplied again to rolling mill 1.

With the electric conductivity stated above, the formation of ignitable electrostatic potentials is reliably prevented throughout the entire plant installation. Furthermore, the residual contamination proportional to these conductivity values is sufficiently low to ensure that the rolling process is not influenced by the contamination in any negative way. On the contrary, the preserved residual contamination improves the grip between the rolls of the rolling mill and the rolled stock, which in turn increases the quality of the rolling process.

Accordingly, while only a single embodiment of the present invention has been shown and described, it is obvious that many changes and modifications may be made thereunto without departing from the spirit and scope of the invention.

What is claimed is:

1. A method for treating and conditioning circulated rolling oil, comprising:

feeding a flocculating agent in a controlled manner to the said rolling oil, the amount of the agent fed depending on residual contamination remaining in the rolling oil;

filtering particles from the circulated rolling oil;

measuring an electric conductivity of the filtered circulated rolling oil to prevent electrostatic charging in the rolling oil; and controlling the amount of flocculating agent fed to the circulated rolling oil based on the measured electric conductivity to keep a minimum amount of particles in the oil to maintain the electric conductivity in the circulated rolling oil in the range of 50 pS/m to 5000 pS/m.

2. The method according to claim 1, wherein the conductivity range is 100 pS/m to 1000 pS/m.

3. The method according to claim 1, wherein the flocculating agent comprises a dicarbonic acid of the general formula

HOOC—A—COOH wherein A is selected from the group consisting of a straight and branched chain with 5 to 15 carbon atoms and phenylene.

* * * * *